United States Patent [19]

Culbertson

[11] 4,125,360

[45] Nov. 14, 1978

[54] STEAM ATOMIZING BURNER

[75] Inventor: James F. Culbertson, San Carlos, Calif.

[73] Assignee: Envirotech Corporation, Menlo Park, Calif.

[21] Appl. No.: 736,621

[22] Filed: Oct. 28, 1976

[51] Int. Cl.[2] ..... F23C 5/08

[52] U.S. Cl. ..... 431/187; 431/4; 431/351; 239/419.5; 239/424; 239/427.5

[58] Field of Search ..... 431/333, 350, 353, 354, 431/181, 187, 159, 278, 284, 351, 265, 285; 239/419.5, 427.5, 428, 424

[56] References Cited

U.S. PATENT DOCUMENTS

| | | | |
|---|---|---|---|
| 1,071,053 | 8/1913 | Hunter | 431/354 |
| 1,887,407 | 11/1932 | Forney | 239/427.5 |
| 2,022,513 | 11/1935 | Macchi | 431/350 |
| 2,391,422 | 12/1945 | Jackson | 239/427.5 |
| 3,139,138 | 6/1964 | Bloom | 431/239 |
| 3,684,189 | 8/1972 | Reed et al. | 239/419.5 |
| 3,773,075 | 11/1973 | Thompson et al. | 431/354 |

*Primary Examiner*—Carroll B. Dority, Jr.
*Attorney, Agent, or Firm*—William S. Bernheim; Robert E. Krebs

[57] ABSTRACT

A steam atomizing burner which can alternatively burn gas, oil or a combination of gas and oil which comprises a burner introducing a major portion of the oxidizer required to produce combustion downstream of the fuel nozzle.

15 Claims, 4 Drawing Figures

STEAM ATOMIZING BURNER

BACKGROUND OF THE INVENTION

1. Field of Use

This invention generally relates to a steam atomizing burner.

2. Prior Art

Oil burners are often mounted to fire through a tile chamber. The tile chamber serves as a secondary ignition device to prevent the relatively cold incoming fuel mixture from blowing the flame from the burner which produces an ignition failure, a condition known as blow off.

Tile chambers are undesireable as they increase the space requirement of a burner. In addition, heat is lost by radiation, the tiles deteriorate and the turndown ratio (maximum divided by minimum heat output) is limited. Turndown ratios of 2-1 to 3-1 are typical. The tiles also prevent burning of fuels which contain components which chemically attack the tiles.

Typically to change burner fuels from gas to oil or the reverse, requires replacing the fuel nozzle which can necessitate shutdown of the apparatus in which the burner is utilized.

In U.S. Pat. No. 2,863,499 a steam atomizing burner is taught which burns a variety of liquid fuels. The burner is operative only at high heat output and has a turndown ratio of less than 2 to 1.

In U.S. Pat. No. 3,326,472 the burner of U.S. Pat. No. 2,863,499 is modified to allow use of gas as an alternative fuel. The modified burner introduces a gas-air mixture to the air tube of the unmodified burner by attaching to the air tube a gas line having specially designed apertures therein for admitting air. When burning gas the modified burner is susceptible to backfire through the aperatures and blow off. To prevent backfire or blow off the range of heat output with gas does not overlap the range of heat output with oil.

Control of burner flame configuration particularly in multiple hearth furnaces, is desireable to prevent melting of metal surfaces or hot spots.

OBJECTS OF THE INVENTIONS

It is an object of this invention to provide a burner having a steam atomizing fuel nozzle and air introduction downstream of the nozzle.

Another object is to provide a burner a burner which achieves mixing and stable combustion without moving parts and does not utilize a tile chamber for secondary ignition.

Yet another object is to provide a furnace burner which can alternatively burn gas, oil or a combination thereof with a turndown ratio of 5 to 1.

BRIEF DESCRIPTION OF THE DRAWINGS

Further objects and advantages of the invention will be apparent from the following detailed description, taken in conjunction with the accompanying drawings illustrating preferred embodiments of the invention.

In the drawings.

DETAILED DESCRIPTION OF THE PREFERRED EMBODIMENT

Figure 1:
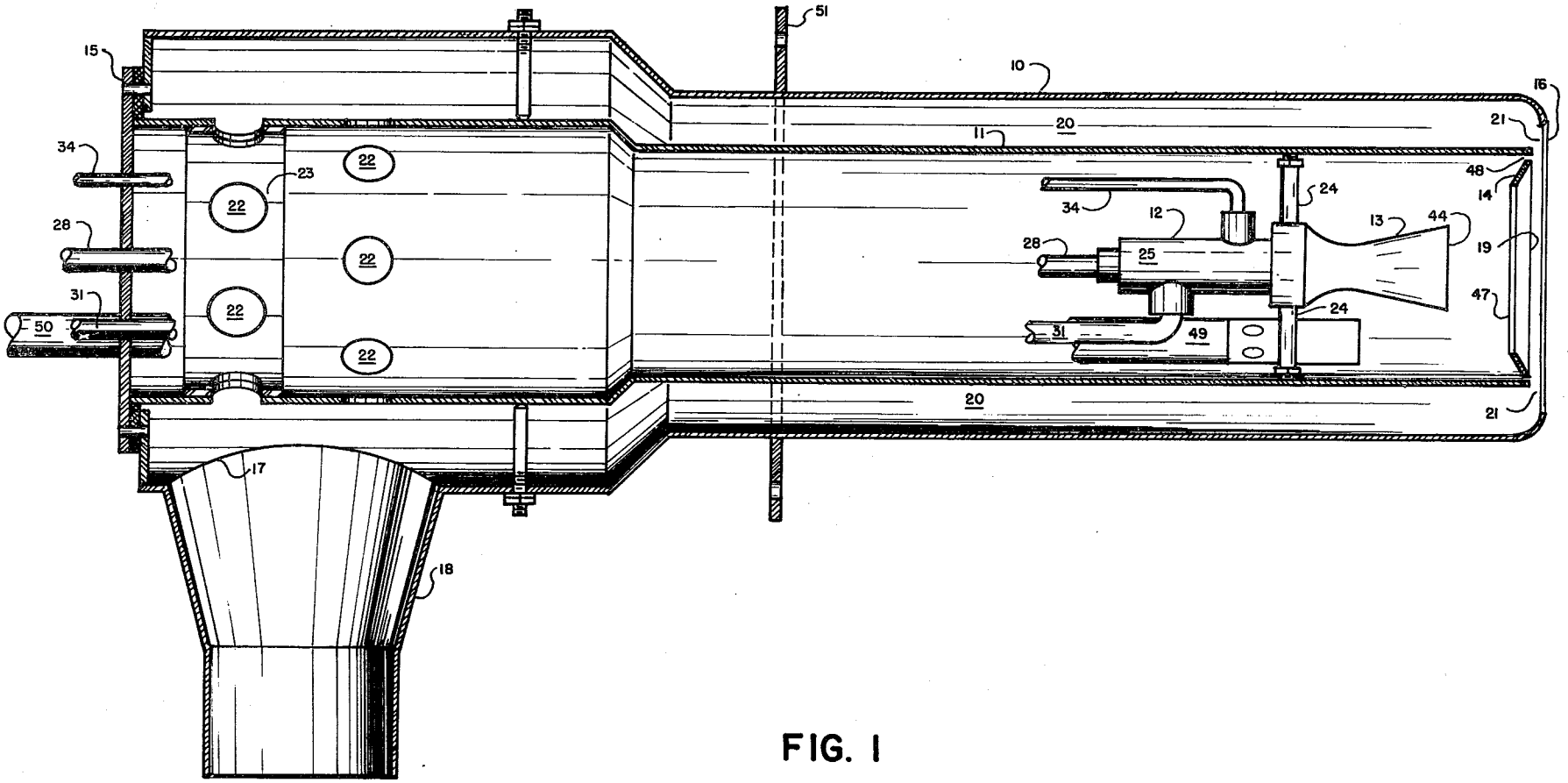
FIG. 1 is a side view partially in section, showing a burner according to the present invention.

The main components of the burner illustrated in FIG. 1 include a first tubular housing 10, a second tubular housing 11, a fuel nozzle 12, a venturi member 13 and a turbulator ring 14, the later three being mounted within the second housing 11. The first housing 10 is an open-ended tubular member. One end of the housing is closed by a plate 15. At the opposite end of the housing there is formed an inwardly directed lip which defines a circular outlet 16. Spaced from said outlet, and preferably adjacent the first end an aperature 17 is formed through the side wall of the first housing 10 and a duct 18 is connected thereabout to convey air into the housing. Fixedly mounted within, spaced thereform and extending the length of the first housing 10 is the second housing 11. The second housing 11 is an open-ended tubular member and the two housings are substantially coaxial at the outlet 16 end of the housings. The second housing is closed at one end by the plate 15 and at the opposite end defines a circular exit 19 adjacent and enclosed by the outlet 16 of the first housing 10.

Defined between the interior wall of the first housing 10 and the exterior wall of the second housing 11 is an annular space 20 which extends from the aperature 17 to the outlet 16. At the outlet 16, the ends of the first and second housings define therebetween an annular orifice 21 to produce a funneling output. Adjacent the aperature 17 and spaced from the exit 19 a plurality of holes 22 are formed through the second housing. The holes 22 are spaced circumferentially about the second housing to allow air passage between the annular space 20 and the interior of the second housing. The holes 22 are sized and a slidable damper 23 provided such that under operating conditions, air admitted through aperature 17 to the annular space 20 is split with a major portion exiting from the orifice 21 and a minor portion exiting through the holes 22 into the second housing 11.

Figure 2:
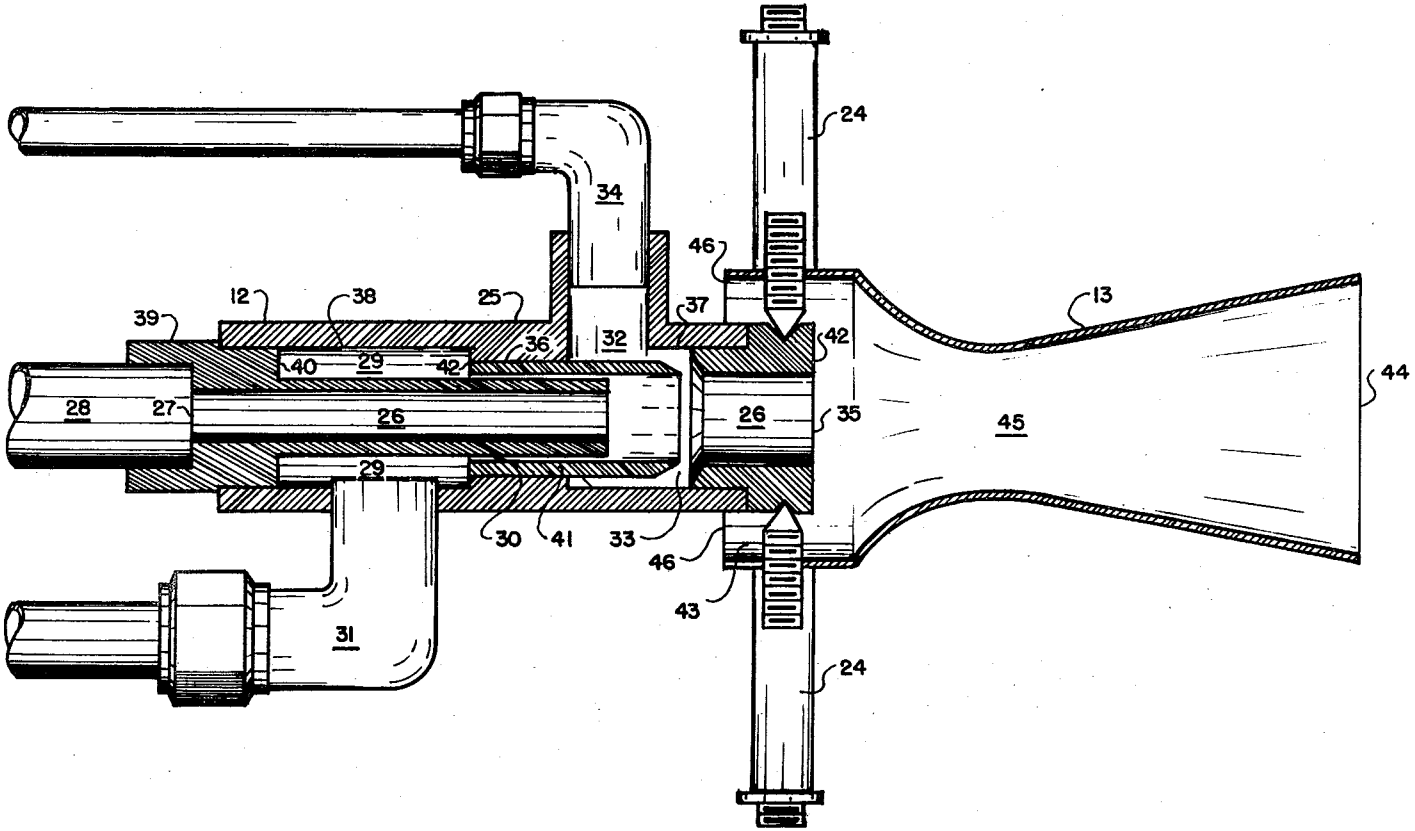
FIG. 2 is an enlarged side view of the fuel nozzle 12 and venturi member 13 shown in FIG. 1.
Figure 3:
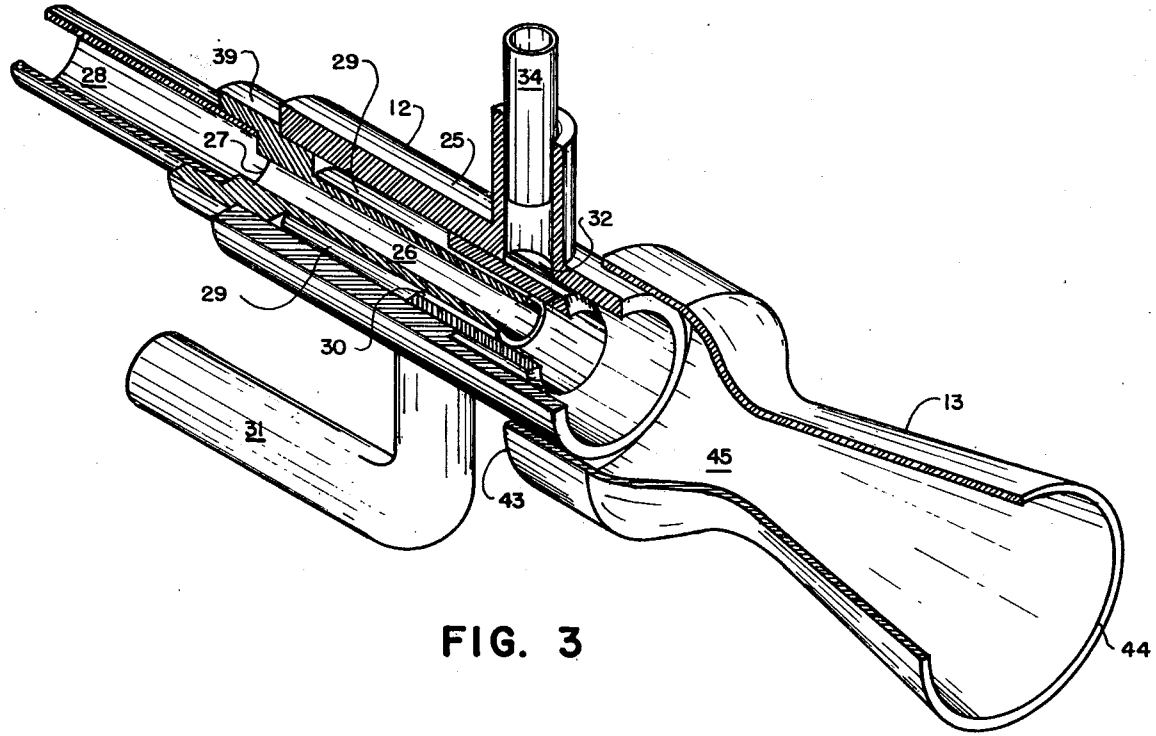
FIG. 3 is a perspective view of the fuel nozzle 12 and venturi member 13 shown in FIG. 1 but with the discharge tube 42 removed.

Referring also to FIGS. 2 and 3, the fuel nozzle 12 is mounted within the second housing 11 by means of struts 24 or similar means which allow translation of the fuel nozzle 12 along the length of the second housing. The fuel nozzle 12 forms an initial mixture of steam and fuel (either gas or oil) and includes a generally cylindrical elongated body 25 having defined therein an open-ended cylindrical mixing chamber 26. At a first end of the mixing chamber 26 is an inlet 27 for admitting gas from conduit 28 into the mixing chamber 26. A portion of the mixing chamber 26 is surrounded by an annular steam chamber 29 having a restricted annular outlet 30 in communication with the mixing chamber 26 which increases in diameter thereat. Connected in communication with the steam chamber is a conduit 31.

A portion of the mixing chamber 26 is also surrounded by an annular oil chamber 32 having a restricted annular outlet 33 in communication with the mixing chamber 26 which increases in diameter thereat. Connected in communication with the oil chamber 32 is a conduit 34. The steam outlet 30 communicates to the mixing chamber between the gas inlet 27 and the oil outlet 33. At the other end of the mixing chamber 26, an open circular outlet 35 is defined to emit the initial mixture of steam with either gas or oil or both in the direction of the outlet 16.

In greater particularity, the mixing chamber 26 is formed with a longitudinal bore 36 connecting and coaxial to a front counterbore 37 and a rear counterbore 38. An inner barrel 39 is fixedly mounted in the cylindrical body 25 to extend coaxially to telescope with the longitudinal bore 36. The exterior wall of the inner barrel 39 and the rear counterbore 38 form walls for the annular steam chamber 29. A backwall 40 of the steam chamber 29 is provided by an increase in the exterior diameter of the inner barrel 39. An outer barrel 41 is mounted in the cylindrical body 25 to extend coaxially with the longitudinal bore 36 and telescope over the inner barrel 39. The interior wall of said outer barrel 41 and exterior wall of the inner barrel 39 define the annular outlet 30. The outer barrel 41 and a portion of the cylindrical body 25 provide the front wall 42 of the steam chamber 29. The inner barrel 39 and the outer barrel 41 are each hollow, circular and symmetrical. The exterior wall of the outer barrel 41 and the front counterbore 37 form walls for the annular oil chamber 32. A hollow circular symmetrical discharge tube 42 is mounted into the front counterbore 37 coaxial with the outer barrel 41 to define the outlet 35 and along with the front counterbore 37 and the exterior wall of the outer barrel 41 to define an oil outlet 33. The conduits supplying the gas, steam and oil inlets of the nozzle 12 pass out of the burner through the plate 15.

The venturi member 13 has a circular entrance 43, discharge 44 and throat 45, therebetween and is fixedly mounted within the second housing 11 by means of the struts 24 to be coaxial with the mixing chamber 26. The entrance 43 is fixedly positioned at a distance from and encloses the outlet 35 to form an annular air inlet 46 surrounding the outlet 35 such that initial mixtures of steam and fuel emitted from the outlet 35 are received into the venturi member 13 and air is aspirated into the venturi member through the inlet 46 by the emission of the initial mixtures from the outlet 35. The discharge 44 is spaced from the exit 19 and emits the initial mixtures and air from the venturi member 13 in the direction of the outlet 16.

The turbulator ring 14 as shown in FIG. 1, has the shape of a truncated cone and is fixedly mounted coaxial with the mixing chamber 26, within the second housing 11 and at the exit 19. The fuel nozzle 12 and venturi member 13 are positioned within the second housing 11 such that a small portion, about 5 to 10% of the initial mixtures and air emitted from the venturi 13 impinges against the turbulator ring 14.

The tubulator ring 14 has its minor diameter nearer the fuel nozzle 12 and therewith forms a circular sharp edged orifice 47 with respect to the mixture emitted from the venturi 13. The major diameter of the turbulator ring is slightly smaller than the inside diameter of the second housing 11 to define between the ring 14 and the interior wall of the second housing 11 a narrow annular orifice 48 at the exit 19. The narrow annular orifice 48 is typically between about $\frac{1}{8}$ inch $\pm$ 1/32 inch in width.

Referring again to FIG. 1, a conventional gas pilot burner 49 or like ignition means is mounted in the second housing 11 at the emission end of the fuel nozzle 12 to ignite the combustion mixture. Piping 50 for the pilot burner 49 passes through the back plate 15. A mounting means 51 attached to the first housing 10 allows the combustion apparatus to be mounted to a furnace wall or the like. The back plate 15 is removable and allows removal of the fuel nozzle 12 and venturi 13 of the burner easily and without necessitating shutdown of an apparatus in which the burner is employed.

In operation of the burner with gas as its fuel, gas, preferably natural gas, under a pressure of between about 5 and 15 psig, enters the fuel nozzle 12 through the gas inlet 27 to the mixing chamber 26 and flows toward outlet 35. Superheated steam enters the fuel nozzle 12 through steam conduit 31 and fills the steam chamber 29 and emits steam toward outlet 35 through outlet 30. The portion of the mixing chamber 26 surrounded by the steam chamber 29 is heated by the steam which in turn preheats the gas. As emitted from outlet 30 the steam forms a flowing annular sleeve of steam evenly distributed about the circumference of the mixing chamber 26 and surrounding the flowing gas. The sleeve configuration slowly dissolves as the gas and steam mixture is emitted at outlet 35 and enters the venturi member 13.

The gas and steam mixture aspirates air into the venturi member 13 from the second housing 11 through inlet 46. Simultaneously pressurized air is supplied to the annular space 20 through the aperature 17 of which a minor portion enters the second housing 11 through the holes 22 and in turn is the air aspirated through inlet 46. The major portion of air entering the annular space 20 is discharged from the orifice 21 in a converging direction toward a confluence with the mixture leaving the exit 19.

In the venturi member 13, the aspirated air initially forms an annular sleeve about the steam which in turn is a sleeve about the gas. The venturi member 13 constricts the air, steam and gas components as they approach the throat 45 producing acceleration of the components. Thereafter, the components expand with violent boundary layer turbulence to an overexpanded condition at the discharge 44. A collapse of the components from this overexpanded condition occurs between the discharge 44 and the exit 19. The acceleration, expansion and collapse achieves superior atomization and mixing of the components.

A portion of the collapsed components circulates about the turbulator ring 14 with the balance of the components passing directly through exit 19. The collapsed components are deficient in combustion air and such deficiency is satisfied by the air discharged from the orifice 21. Once ignited by the pilot burner 49, combustion is self sustaining.

In operation of the burner with oil as the fuel, pressurized steam enters the fuel nozzle 12 through conduit 31 to fill the steam chamber 29 which in turn feeds steam through outlet 30 into the mixing chamber 26 in the form of a flowing sleeve. Oil is fed at a pressure between about 5 and 15 psig through conduit 34 into oil chamber 32. Suitable oil (liquid) fuels include No. 2 fuel oil, No. 6 fuel oil, residual oil, bunker "C" oil and "slop" oil. From the oil chamber 32 the oil is discharged toward outlet 35 through outlet 33 as a flowing annular sleeve of oil evenly distributed about the circumference of the mixing chamber 26 and surrounding the annular sleeve of flowing steam. This double sleeve configuration is slowly dissolved as the steam and oil mixture is emitted at outlet 35 and enters the venturi member 13.

In the venturi member 13 the steam and oil mixture aspirates air through inlet 46. The components emitted from the venturi member 13 impinge on the turbulator ring 14 as in gas burning. Introduction of a small portion of air or gas through the gas inlet 27 can assist formation of the annular sleeve of steam emitted from outlet 30.

The venturi member 13 is optional for gas or oil operation but its presence is preferred. In the absence of the venturi member 13, the fuel nozzle 12 is positioned further from the outlet 16 then otherwise to provide impingement on the turbulator ring 14. In oil burning the burner needs to be at operating temperatures before the venturi member 13 can be absent. Operation without the venturi member 13 produces a longer thinner flame.

The air flowing through the annular space 20 cools the burner, housing adjacent the outlet 16. The heated air is discharged through the orifice 21. Such heating of the air increases the burner combustion efficiency and draws heat from the burner housing where it can be detrimental to the burner's longevity or wasted heating the surroundings. Approximately 20-30% of the combustion requirement of air is introduced through the holes 22 and drawn through the inlet 46. The balance of combustion air including any excess is provided through the orifice 21. Varying the ratio of air between the holes 22 and the orifice 21 can be used to affect the flame configuration. The air provided to the orifice 21 also provides pressure directed away from the burner to prevent recirculation of exhaust gases into the second housing 11 and ingestion of dust.

The air in the second tubular housing 11 is in a static condition in the area outside the venturi member 13 between the entrance 43 and the discharge 44. The damper 23 is adjusted to maintain a negative pressure in the second housing 11 and to cause a small amount of the air provided at the orifice 21 to be induced to reverse its flow and flow into the second housing 11 through the narrow annular orifice 48 where it is met by the outer fringes of the fuel-rich mixture exiting the venturi member 13 and contributes to causing a circulation of fuel mixture around the turbulator ring 14 where, when once ignited, a stationary ring of flame is formed and serves to ignite the emitting fuel/air mixture.

The steam is superheated to assure a steam temperature as the steam leaves outlet 30 of about 125°-150° C. The steam leaving the outlet 30 also serves as a steam eductor with respect to the incoming gases from the gas inlet 27 and the incoming oils from the outlet 33 and thereby significantly reduces the pressure required to force either the gas or oil into the fuel nozzle 12. Unexpected gas economy in terms of useful Btu outptut in the order of 30% is experienced. Steam consumption when burning oil, is typically 21.8 lbs. per million Btu regardless of the oil firing rate. Steam consumption, when burning natural gas, is typically 8 lbs. per million Btu.

The burner can also burn a combination of oil and gas. With a knowledge of burning with either oil or gas, operation with a combination of oil and gas is within the ability of the skilled person. In this mode, at the outlet 35, gas is sleeved by steam which in turn is sleeved by oil.

During operation, the burner's design causes the preponderance of the combustion to occur outside the burner adjacent the outlet 16. This is advantageous when the burner is used in combination with a multiple hearth furnace. The orifice 21 can also serve as an auxiliary input means for introducing additional gaseous components to the furnace. With little difficulty sufficient air can also be provided at the orifice 21 during shutdown of the fuel nozzle to prevent the ingestion of dust and through the holes 22 to discharge any dust ingested.

As shown in FIG. 1, oil introduction to the burner nozzle 12 is made at the top through conduit 34 and the gravity distribution about the oil chamber 32 is sufficient to achieve equal distribution of feed from the oil chamber 32 to the outlet 33. If the burner nozzle is pointed directly downward or the oil conduit is not in position to take advantage of gravity distribution, some other type of auxiliary means to spread the oil evenly about the oil chamber 32 is necessary. If the burner nozzle 12 is pointed directly downward it is sufficient if the oil chamber 32 is located to the outlet 35 side of the oil outlet 33.

Figure 4:
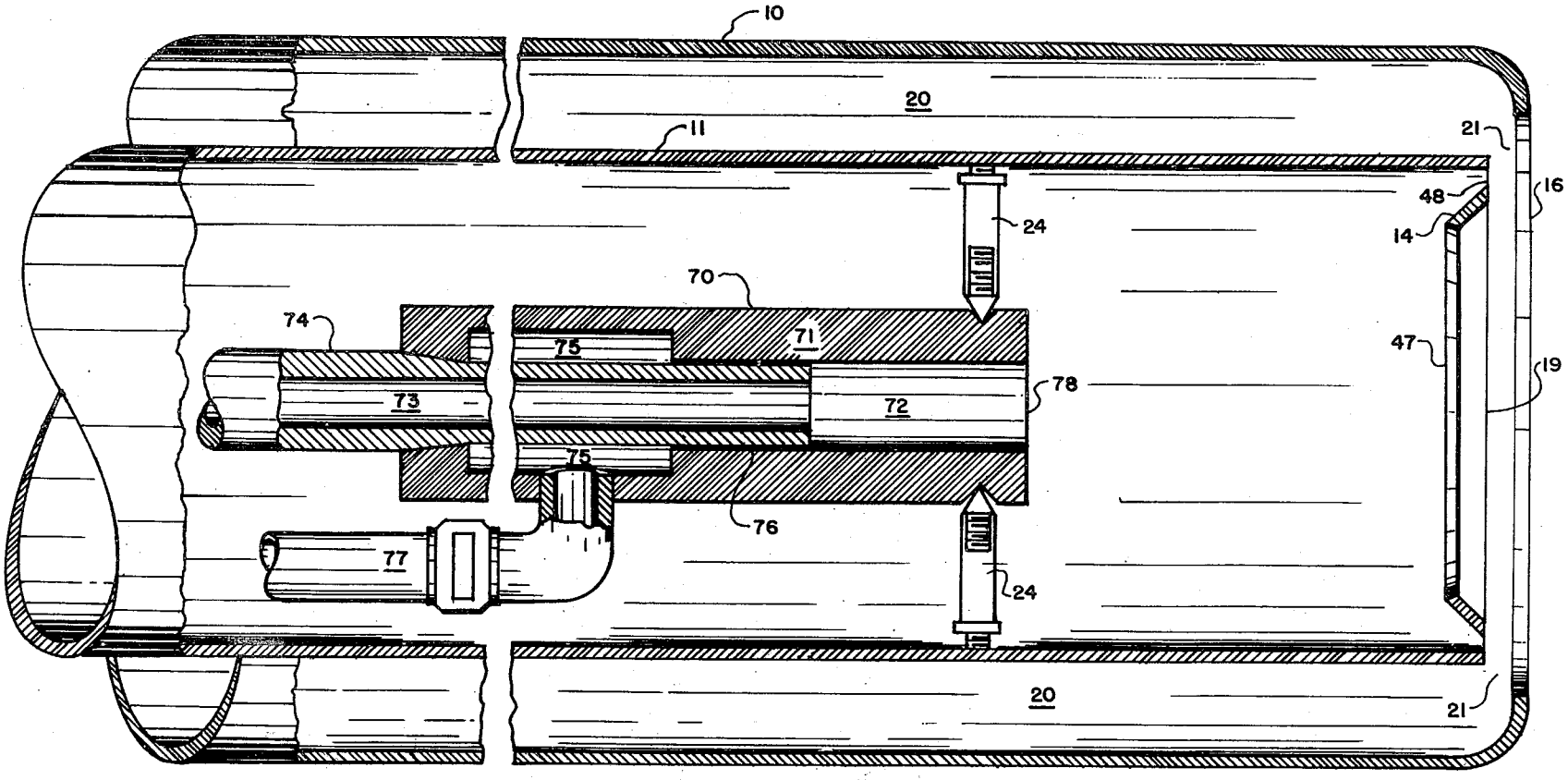
FIG. 4 is a side view showing a gas fuel nozzle according to the present invention.

The fuel nozzle 12 can be modified as shown in FIG. 4 for burning gas only. The modified gas nozzle 70 is fixedly mounted in place of fuel nozzle 12 within the second housing 11. The fuel nozzle 70 includes a generally cylindrical elongated body 71 having therein an open-ended cylindrical mixing chamber 72. At a first end of the mixing chamber 72 is an inlet 73 for admitting gas into the chamber 72. Providing gas to the gas inlet 73 is a conduit 74. A portion of the chamber 72 is surrounded by an annular chamber 75 for steam having a restricted annular outlet 76 in communication with the mixing chamber which increases in diameter thereat. In communication with the steam chamber 75 is a steam conduit 77. The other end of the mixing chamber 73 defines a circular mixture outlet 78 to emit an initial mixture of steam and gas in the direction of the outlet 16. The venturi member 13 can be optionally mounted to surround the outlet 78.

In operation, the modified gas nozzle 70 operates in the same manner as fuel nozzle 12 for gas burning. Gas enters the mixing chamber 72 through the gas inlet 73. Superheated steam enters to fill the steam chamber 75 through steam conduit 77. From the steam chamber 75 the steam is discharged through the outlet 76 in the form of a flowing annular sleeve of steam evenly distributed about the circumference of the mixing chamber 72 to surround the flowing gas. This initial mixture of gas and steam is then emitted from outlet 78 and is acted upon as discussed supra.

I claim:

1. A combustion apparatus comprising:

a. a first tubular housing having a closed end and an opposite open end whereat an inwardly directed lip is formed to define a first outlet;

b. an aperture means for admitting air to said first housing spaced from said first outlet;

c. a second tubular housing fixedly mounted within said first housing, said second housing having a closed end and an opposite end which defines an exit adjacent and enclosed by said first outlet so that an annular space is defined between the interior of said first housing and the exterior of said second housing extending from said aperture means to said first outlet whereat an annular orifice is formed and said annular space passes a major portion of air admitted to said first housing by said aperture means to emit at said orifice;

d. means connected to admit air from said annular space into said second tubular housing at a location spaced from said exit;

e. a fuel nozzle mounted within said second tubular housing wherein an initial mixture of steam and a fluid fuel is formed; said fuel nozzle further having a mixture outlet within said second housing, said mixture outlet to emit said initial mixture in a direction toward said exit and a confluence with said major portion of air; said major portion providing air for combusting said initial mixture; and f. a turbulator ring fixedly mounted within said second housing at said exit between said mixture outlet and said exit thereby to define a sharp-edged orifice with respect to said emitted initial mixture from said mixture outlet and to define a narrow annular orifice between said tubulator ring and the interior of said second housing.

2. The combustion apparatus of claim 1 wherein said fuel nozzle is a generally cylindrical elongated body having therein an open-ended cylindrical mixing chamber having at a first end an inlet for admitting gas to said mixing chamber, an opposite end defining said mixture outlet and a portion surrounded by an annular chamber for steam having a restricted annular outlet in communication with said mixing chamber which increases in diameter thereat.

3. The combustion apparatus of claim 1 wherein said fuel nozzle is a generally cylindrical elongated body having therein an open-ended cylindrical mixing chamber, said mixing chamber having an end defining said mixture outlet, a portion surrounded by a first annular chamber for steam having a restricted annular outlet in communication with the said mixing chamber which increases in diameter thereat and a portion surrounded by a second annular chamber for oil having a restricted annular outlet in communication with said mixing chamber which increases in diameter thereat, said oil outlet being between said steam outlet and said mixture.

4. The combustion apparatus of claim 1 wherein said fuel nozzle is a generally cylindrical elongated body having therein an open-ended cylindrical mixing chamber having at a first end an inlet for admitting gas to said mixing chamber, an opposite end defining said mixture outlet, a portion surrounded by a first annular chamber for steam having a restricted annular outlet in communication with said mixing chamber which increases in diameter thereat, and a portion surrounded by a second annular chamber for oil having a restricted annular outlet in communication with said mixing chamber which increases in diameter thereat, said oil outlet being between said steam outlet and said mixture outlet.

5. A combustion apparatus comprising:

a. a first tubular housing having a closed end and an opposite open end whereat an inwardly directed lip is formed to define a first outlet;

b. an aperture means for admitting air to said first housing spaced from said first outlet;

c. a second tubular housing fixedly mounted within said first housing, said second housing having a closed end and an opposite end which defines an exit adjacent and enclosed by said first outlet so that an annular space is defined between the interior of said first housing and the exterior of said second housing extending from said aperture means to said first outlet whereat an annular orifice is formed and said annular space passes a major portion of air admitted to said first housing by said aperture means to emit at said orifice;

d. means connected to admit air from said annular space into said second tubular housing at a location spaced from said exit;

e. a fuel nozzle mounted within said second tubular housing wherein an initial mixture of steam and a fluid fuel is formed; said fuel nozzle further having a mixture outlet to emit and a confluence with said major portion of air; said major portion providing air for combusting said initial mixture;

f. a turbulator ring fixedly mounted within and at the exit of said second housing to define a sharp-edged orifice with respect to said emitted initial mixture from said mixture outlet and to define a narrow annular orifice between said tubulator ring and the interior of said second housing; and g. a venturi member mounted in said second housing, said member having a throat, an entrance fixedly positioned at a distance from and enclosing said mixture outlet to receive the initial mixture of steam and fuel fluid emitted from said mixture outlet such that air is aspirated into said member through said entrance by the emission of said initial mixture from said mixture outlet and a discharge to emit said aspirated air and said initial mixture toward said first outlet.

6. The combustion apparatus of claim 5 wherein said fuel nozzle is a generally cylindrical elongated body having therein an open-ended cylindrical mixing chamber having at a first end an inlet for admitting gas to said mixing chamber, an opposite end defining said mixture outlet and a portion surrounded by an annular chamber for steam having a restricted annular outlet in communication with said mixing chamber which increases in diameter thereat.

7. The combustion apparatus of claim 5 wherein said fuel nozzle is a generally cylindrical elongated body having therein an open-ended cylindrical mixing chamber, said mixing chamber having an opposite end defining said mixture outlet, a portion surrounded by an annular chamber for steam having a restricted annular outlet in communication with the said mixing chamber which increases in diameter thereat and a portion surrounded by an annular chamber for oil having a restricted annular outlet in communication with said mixing chamber which increases in diameter thereat, said oil outlet being between said steam outlet and said mixture outlet.

8. The combustion apparatus of claim 5 wherein said fuel nozzle is a generally cylindrical elongated body having therein an open-ended cylindrical mixing chamber having at a first end an inlet for admitting gas to said mixing chamber, an opposite end defining said mixture outlet, a portion surrounded by an annular chamber for steam having a restricted annular outlet in communication with said mixing chamber which increases in diameter thereat, and a portion surrounded by an annular chamber for oil having a restricted annular outlet in communication with said mixing chamber which increases in diameter thereat, said oil outlet being between said steam outlet and said mixture outlet.

9. The combustion apparatus of claim 8 wherein said means is a plurality of holes formed through said second housing and spaced circumferentially about said second housing.

10. The combustion apparatus of claim 9 wherein said aperature means is sized to emit at least a combustion requirement of air for said initial mixture and said plurality of holes are sized to admit approximately 20% to 30% of said combustion requirement to said second housing.

11. The combustion apparatus of claim 8 further including a multiple hearth furnace to which said first housing is mounted.

12. The combustion apparatus of claim 1 further including a multiple hearth furnace to which said first housing is mounted.

13. A combustion apparatus comprising:

a. a first tubular housing having a closed end and an opposite open end whereat an inwardly directed lip is formed to define a first outlet;

b. an aperture means for admitting air to said first housing spaced from said first outlet;

c. a second tubular housing fixedly mounted within said first housing, said second housing having a closed end and an opposite end which defines an exit adjacent and enclosed by said first outlet so that an annular space is defined between the interior of said first housing and the exterior of said second housing extending from said aperture means to said first outlet whereat an annular orifice is formed and said annular space passes a major portion of air admitted to said first housing by said aperture means to emit at said orifice;

d. means connected to admit air from said annular space into said second tubular housing at a location spaced from said exit;

e. a fuel nozzle mounted within said second tubular housing wherein an initial mixture of steam and a fluid fuel is formed; said fuel nozzle including a generally cylindrical elongated body having therein an open-ended cylindrical mixing chamber having at a first end an inlet for admitting gas to said mixing chamber; an opposite end defining a mixture outlet to emit said initial mixture in a direction toward said exit and a confluence with said major portion of air, said major portion providing air for combusting said initial mixture; a portion surrounded by an annular chamber for steam having a restricted annular outlet diameter thereat; and a portion surrounded by an annular chamber for oil having a restricted annular outlet in communication with said mixing chamber which increases in diameter thereat, said oil outlet being between said steam outlet and said mixture outlet;

f. a turbulator ring fixedly mounted within and at the exit of said second housing to define a sharp-edged orifice with respect to said emitted initial mixture from said mixture outlet and to define a narrow annular orifice between said tubulator ring and the interior of said second housing; and g. a multiple hearth furnace to which said first housing is mounted.

14. A combustion apparatus comprising:

a. a first tubular housing having a closed end and an opposite end whereat an inwardly directed lip is formed to define a first outlet;

b. an aperture means for admitting air to said first housing spaced from said first outlet;

c. a second tubular housing fixedly mounted within said first housing, said second housing having a closed end and an opposite end which defines an exit adjacent and enclosed by said first outlet so that an annular space is defined between the interior of said first housing and the exterior of said second housing extending from said aperture means to said first outlet whereat an annular orifice is formed and said annular space passes a major portion of air admitted to said first housing by said aperture means to emit at said orifice;

d. means connected to admit air from said annular space into said second tubular housing at a location spaced from said exit;

e. a fuel nozzle mounted within said second tubular housing wherein an initial mixture of steam and a fluid fuel is formed; said fuel nozzle including a generally cylindrical elongated body having therein an open-ended cylindrical mixing chamber having at a first end an inlet for admitting gas to said mixing chamber; and opposite end defining a mixture outlet to emit said initial mixture in a direction toward said exit and a confluence with said major portion of air, said major portion providing air for combusting said initial mixture; a portion surrounded by an annular chamber for steam having a restricted annular outlet in communication with said mixing chamber which increases in diameter thereat; and a portion surrounded by an annular chamber for oil having a restricted annular outlet in communication with said mixing chamber which increases in diameter thereat, said oil outlet being between said steam outlet and said mixture outlet; said cylindrical elongated body being formed with a longitudinal bore connecting and coaxial to a front counterbore and a rear counterbore, said bores having mounted therein an inner barrel extending coaxially to telescope with said longitudinal bore and an outer barrel extending coaxially with said longitudinal bore to telescope over said inner barrel and a hollow circular discharge tube mounted into said front counterbore coaxial with said outer barrel to define said mixture outlet and a portion of said oil outlet; said steam outlet being defined between the exterior of said inner barrel and the interior of said outer barrel; and f. a turbulator ring fixedly mounted within and at the exit of said second housing to define a sharp-edged orifice with respect to said emitted initial mixture from said mixture outlet and to define a narrow annular orifice between said tubulator ring and the interior of said second housing.

15. The combustion apparatus of claim 14 further including a venturi member mounted in said second housing, said member having a throat, an entrance fixedly positioned at a distance from and enclosing said mixture outlet to receive the initial mixture of steam and fuel fluid emitted from said mixture outlet such that air is aspirated into said member through said entrance by the emission of said initial mixture from said mixture outlet and a discharge to emit said aspirated air and said initial mixture toward said first outlet.

* * * * *